US010916901B2

(12) United States Patent
Pendergrass et al.

(10) Patent No.: US 10,916,901 B2
(45) Date of Patent: Feb. 9, 2021

(54) ELECTRICAL CONNECTORS WITH ELECTRICAL BONDING FEATURES

(71) Applicant: FilConn Inc., Chandler, AZ (US)

(72) Inventors: Mark Pendergrass, Climax, NC (US); Jason Pedruzzi, Wichita, KS (US); David Davis, Gilbert, AZ (US)

(73) Assignee: FilConn Inc., Chandler, AZ (US)

( * ) Notice: Subject to any disclaimer, the term of this patent is extended or adjusted under 35 U.S.C. 154(b) by 0 days.

(21) Appl. No.: 16/676,095

(22) Filed: Nov. 6, 2019

(65) Prior Publication Data

US 2020/0144773 A1 May 7, 2020

Related U.S. Application Data

(60) Provisional application No. 62/756,885, filed on Nov. 7, 2018.

(51) Int. Cl.

| | |
|---|---|
| ***H01R 13/74*** | (2006.01) |
| ***H01R 43/20*** | (2006.01) |
| ***H01R 13/502*** | (2006.01) |
| ***H01R 13/405*** | (2006.01) |
| *H01R 13/6582* | (2011.01) |
| *H01R 24/52* | (2011.01) |
| *H01R 13/6583* | (2011.01) |
| *H01R 13/6596* | (2011.01) |

(52) U.S. Cl.

CPC ..... *H01R 13/74* (2013.01); *H01R 13/405* (2013.01); *H01R 13/502* (2013.01); *H01R 43/205* (2013.01); *H01R 13/6582* (2013.01); *H01R 13/6583* (2013.01); *H01R 13/6596* (2013.01); *H01R 13/741* (2013.01); *H01R 13/743* (2013.01); *H01R 24/52* (2013.01); *Y10S 439/939* (2013.01)

(58) Field of Classification Search

CPC ..... H01R 13/6596; H01R 13/6582; H01R 13/6583; H01R 13/74; H01R 13/741; H01R 13/743; H01R 24/52; H01R 43/205; Y10S 439/939

See application file for complete search history.

(56) References Cited

U.S. PATENT DOCUMENTS

| | | | | | |
|---|---|---|---|---|---|
| 903,768 | A * | 11/1908 | Platt | | |
| 3,200,366 | A * | 8/1965 | Stuart | F16J 15/04 | 439/551 |
| 3,753,212 | A * | 8/1973 | Yamada | H01R 13/514 | 439/358 |
| 5,879,186 | A * | 3/1999 | Harada | F21S 41/194 | 439/549 |
| 6,822,879 | B2 * | 11/2004 | Rathnam | G02B 6/4277 | 361/818 |

(Continued)

*Primary Examiner* — Tho D Ta

(74) *Attorney, Agent, or Firm* — Fox Rothschild LLP

(57) ABSTRACT

Receptacles are provided for mating with plugs to establish electrical connections. The receptacles include a shell having a body, and a flange attached to the body. The flange has a projection extending therefrom. The receptacle also has an electrically-insulating insert positioned at least in part within the body; and one or more electrical contacts positioned at least in part within the insert. The receptacle is configured for mounting on a panel. The projection contacts a mounting surface of the panel, to establish a localized contact area that provides bonding between the receptacle and panel.

19 Claims, 8 Drawing Sheets

(56) References Cited

U.S. PATENT DOCUMENTS

| | | | | |
|---|---|---|---|---|
| 7,150,653 | B1 * | 12/2006 | Mason | H05K 9/0058 439/607.18 |
| 7,525,818 | B1 * | 4/2009 | McAlonis | H05K 9/0018 361/818 |
| 8,500,486 | B2 * | 8/2013 | Buck | H01R 13/74 439/551 |
| 8,672,710 | B2 * | 3/2014 | Feldstein | H01R 13/6594 439/607.28 |
| 10,680,390 | B2 * | 6/2020 | Sanger | H01R 13/6598 |
| 2018/0294583 | A1 * | 10/2018 | Shen | H01P 5/12 |

* cited by examiner

ELECTRICAL CONNECTORS WITH ELECTRICAL BONDING FEATURES

CROSS-REFERENCE TO RELATED APPLICATIONS

This application claims the benefit of priority to U.S. Provisional Patent Application No. 62/756,885, filed Nov. 7, 2018, the disclosure of which is incorporated by reference herein in its entirety.

FIELD

The inventive concepts disclosed herein relate to electrical connectors that require electrical bonding to a grounded component.

BACKGROUND

Electrical connectors typically include a plug, and a socket or receptacle that mates with the plug to establish an electrical connection. Certain types of electrical connectors are grounded through the panel on which the connector is mounted. The receptacles of such connectors typically include an electrically-conductive shell, and one or more contacts positioned within an electrically-insulating insert mounted in the shell. A portion of the shell may extend through an opening in the panel, and the receptacle can be secured to the panel by way of a flange that forms another portion of the shell.

The receptacle is electrically bonded to the panel by contact between the flange and the contacting surface of the panel. Insufficient and/or non-uniform contact pressure between the flange and the panel; localized gaps between the adjacent surfaces of flange and the panel resulting from non-planar conditions on one or both surfaces; and other factors can adversely affect the bonding, i.e., can increase the grounding resistance, between the shell and the panel. Excessive grounding resistance can be detrimental to the signal-to-noise ratio of the connector, and in some cases can result in signal-to-noise ratios that interfere with the satisfactory operation of the various electrical components being interconnected by way of the connector.

SUMMARY

In one aspect, receptacles for mating with plugs to establish electrical connections include one or more electrical contacts, and an electrically-insulating insert. The electrical contacts are positioned at least in part within the insert. The receptacles also include a shell configured for mounting on a substantially planar mounting surface. The shell has a body, and a flange attached to the body. The insert is positioned at least in part within the body; and the flange includes a projection configured to contact the mounting surface when the receptacle is mounted.

In another aspect, the mounting surface is a substantially planar surface of a panel; and the contact between the projection and the mounting surface electrically bonds the shell to the panel.

In another aspect, the projection is a rib.

In another aspect, the flange has a surface configured to face the panel when the receptacle is mounted on the panel; and the projection extends from the surface of the flange.

In another aspect, the projection extends along a circular path on the surface.

In another aspect, the projection is continuous.

In another aspect, the projection has a width of about 0.025 inch to about 0.035 inch.

In another aspect, the projection has a height of about 0.015 inch to about 0.025 inch.

In another aspect, the projection has a substantially D-shaped cross section.

In another aspect, the projection has a substantially triangular cross section.

In another aspect, the projection has a substantially arcuate outer surface.

In another aspect, the projection is disposed substantially symmetrically about a longitudinal centerline of the receptacle.

In another aspect, the projection is ring shaped.

In another aspect, the electrical contacts are receptacle contacts.

In another aspect, the electrical contacts are pin contacts.

In another aspect, the body and the flange of the shell are unitarily formed.

In another aspect, electrical connectors include a receptacle and a plug configured to mate with the receptacle to establish an electrical connection. The receptacle includes one or more electrical contacts, and an electrically-insulating insert. The electrical contacts are positioned at least in part within the insert. The receptacle also includes a shell configured for mounting on a substantially planar mounting surface. The shell has a body, and a flange attached to the body. The insert is positioned at least in part within the body; and the flange includes a projection configured to contact the mounting surface when the receptacle is mounted.

In another aspect, methods for bonding receptacles of electrical connectors to panels include providing a receptacle. The receptacle includes a shell having a body, and a flange attached to the body and having a projection. The receptacle also includes an electrically-insulating insert positioned at least in part within the body; and one or more electrical contacts positioned at least in part within the insert.

The methods also include inserting a portion of the receptacle through an aperture in the panel so that the projection contacts a surface of the panel adjacent the aperture; and securing the receptacle to the panel.

In another aspect, securing the receptacle to the panel includes fastening the flange to the panel so that a contact pressure between the projection and the surface of the panel is substantially uniform along the projection.

In another aspect, securing the receptacle to the panel includes fastening the flange to the panel so that substantially all contact between the flange and the surface of the panel occurs by way of the projection.

BRIEF DESCRIPTION OF THE DRAWINGS

Embodiments will be described with reference to the following drawing figures, in which like reference numerals represent like parts and assemblies throughout the several views.

DETAILED DESCRIPTION

The inventive concepts are described with reference to the attached figures. The figures are not drawn to scale and are provided merely to illustrate the instant inventive concepts. The figures do not limit the scope of the present disclosure. Several aspects of the inventive concepts are described below with reference to example applications for illustration. It should be understood that numerous specific details, relationships, and methods are set forth to provide a full understanding of the inventive concepts. One having ordinary skill in the relevant art, however, will readily recognize that the inventive concepts can be practiced without one or more of the specific details or with other methods. In other instances, well-known structures or operation are not shown in detail to avoid obscuring the inventive concepts.

The figures depict a connector 10. The connector 10 is a MIL-DTL-5015 Series III circular connector. The inventive concepts disclosed herein are described in connection with this particular type of connector for exemplary purposes only; the inventive concepts can be applied to other types of connectors, including but not limited to other types of circular connectors, and D-submarine (D-sub) connectors.

Figure 1:
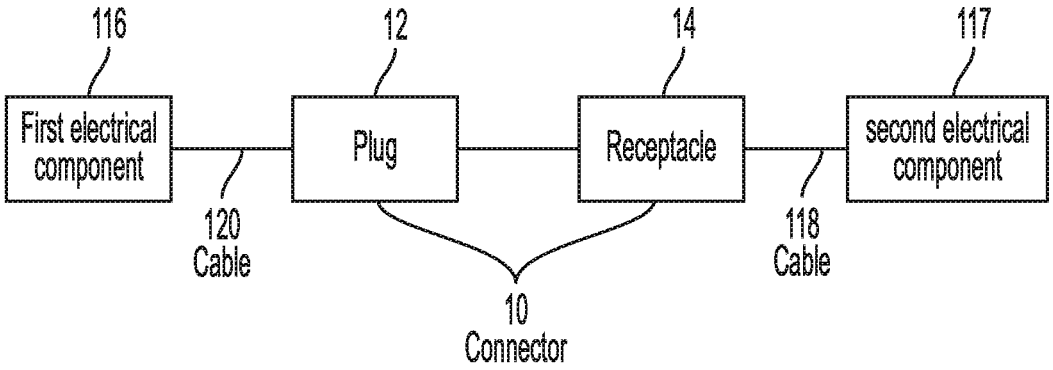
FIG. 1 is a schematic illustration of an electrical interconnection between two electrical components, facilitated by an electrical connector having a receptacle and a plug.

The connector 10 comprises a plug 12 and a socket, or receptacle 14. The plug 12 is configured to mate with the receptacle 14 to establish an electrical connection between a first electrical component 116 in electrical contact with the plug 12, and a second electrical component 117 in electrical contact with the receptacle 14. The first electrical component 116 and the second electrical component 117 are depicted schematically in FIG. 1. The plug 12 and the receptacle 14 are retained in a mated condition by a threaded coupling; the inventive concepts can be applied to connectors having other types of retaining features, such as bayonet connectors.

Figure 2:
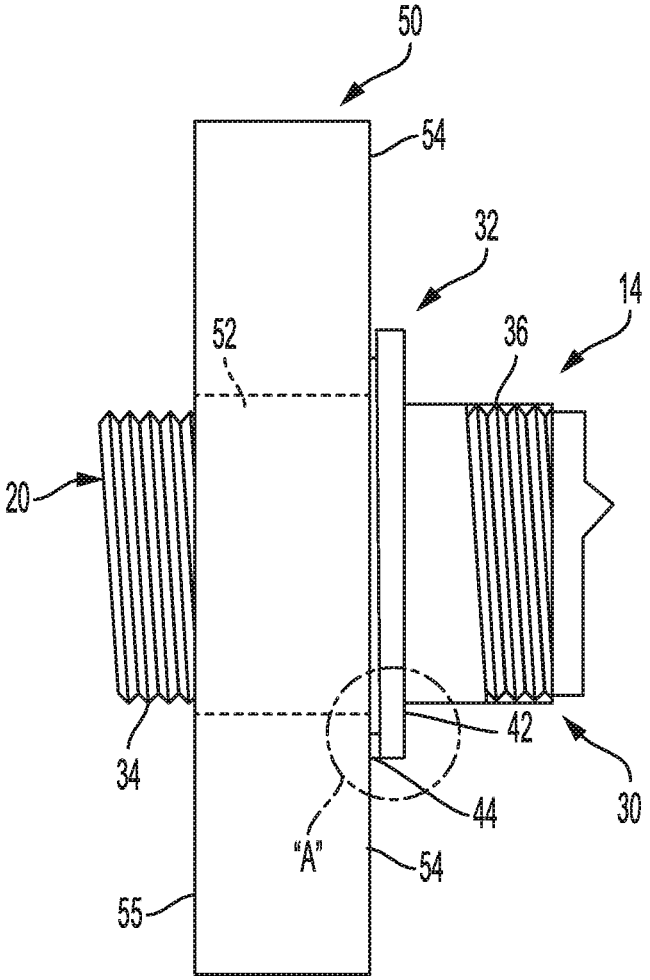
FIG. 2 is a side view of the receptacle of the connector shown in FIG. 1, installed on a panel.

The receptacle 14 is a wall-mount receptacle; the inventive concepts can be applied to other types of receptacles, such as box-mount and jam-nut receptacles. The receptacle 14 is configured for mounting on a grounded, electrically-conductive panel 50 having a substantially planar mounting surface 54, as illustrated in FIG. 2. The panel 50 can be part of a wall, a cabinet, or other type of structure suitable for mounting an electrical connector.

Referring to FIGS. 2-5, the receptacle 14 comprises a shell 20, an insert 22 housed within the shell 20, and a plurality of electrical contacts 24 mounted within the insert 22. The shell 20 includes a single-piece body 30, and a flange 32 attached to the body 30. The flange 32 is unitarily formed with the body 30. The flange 32 and the body 30 can be formed separately, and the body 30 can be formed as a split, or two-piece body in alternative embodiments.

The body 30 has a forward portion 34 and a rearward portion 36 located on opposite sides of the flange 32. The forward portion 34 and the rearward portion 36 each have external threads formed thereon, the purpose of which is discussed below. The shell 20 is formed from a suitable electrically-conductive material such as nickel-plated aluminum alloy; the shell 20 can be formed from other types of materials in the alternative.

The body 30 defines a substantially cylindrical internal volume. The insert 22 is positioned within the internal volume. The insert 22 can be formed from a high-grade, dielectric thermoplastic material, and can be retained within the internal volume by an interference fit or other suitable means. The insert 22 can be formed from other types of materials, and can be retained within the internal volume by other means, in alternative embodiments.

Figure 3:
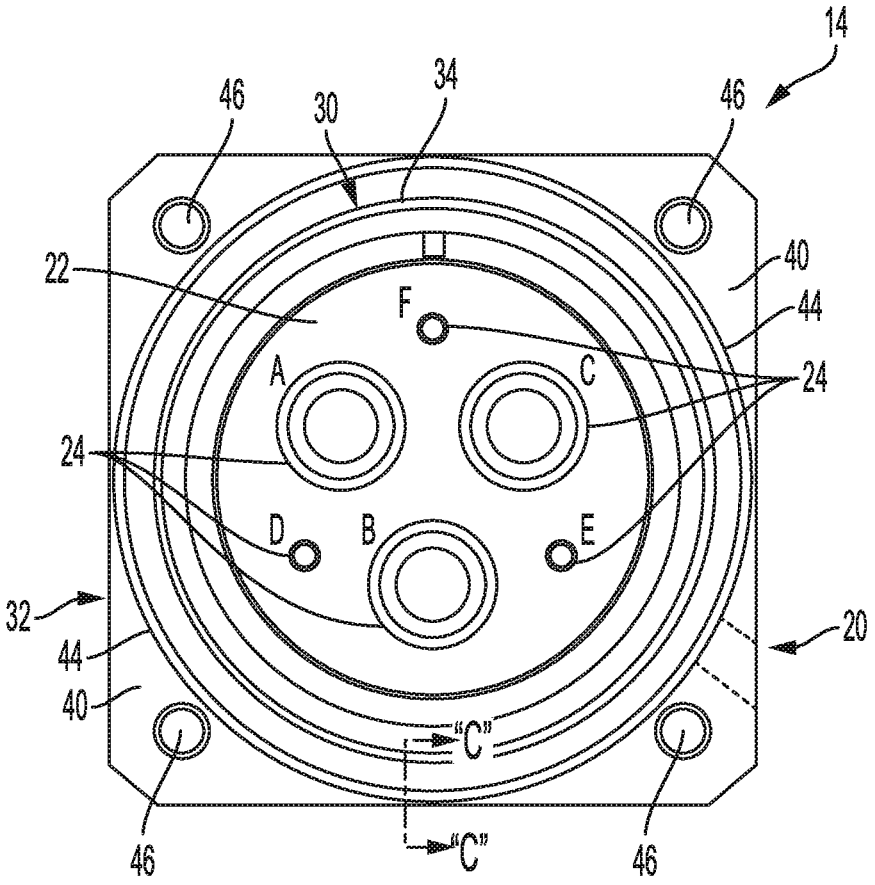
FIG. 3 is a front view of the receptacle shown in FIGS. 1 and 2.
Figure 4:
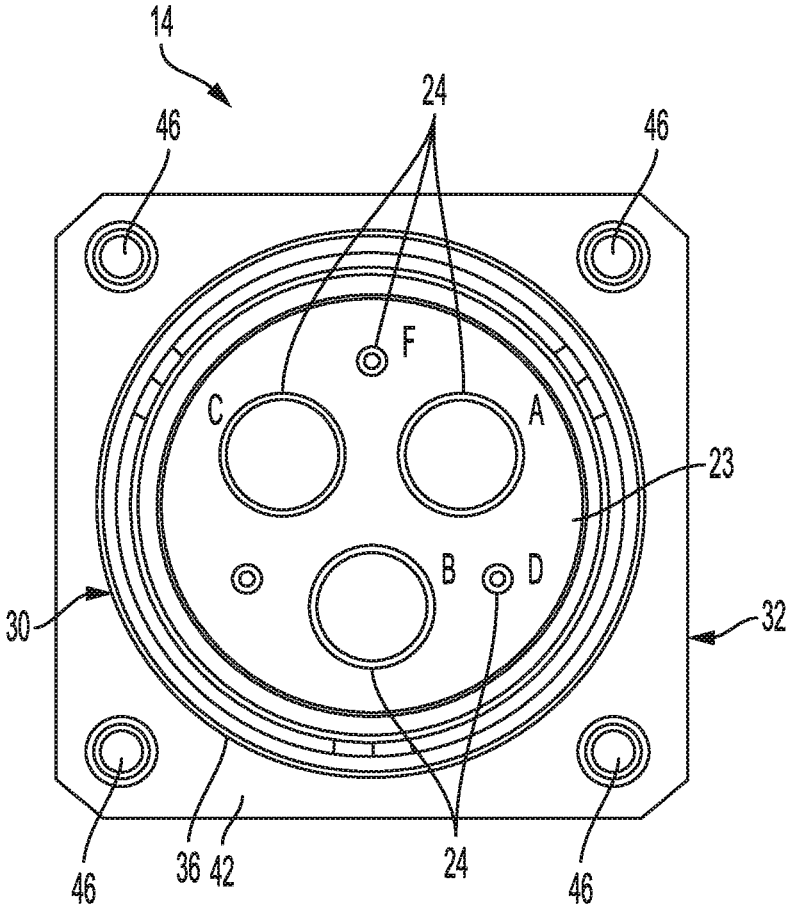
FIG. 4 is a rear view of the receptacle shown in FIGS. 1-3.
Figure 5:
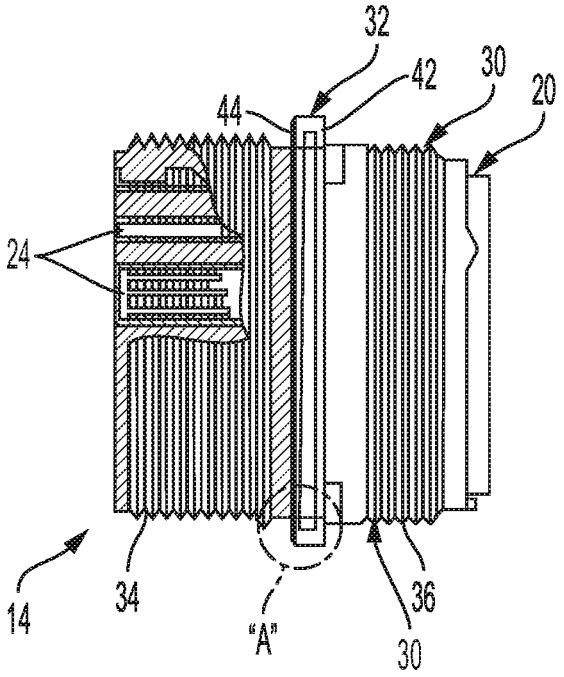
FIG. 5 is a side, partial-cutaway view of the receptacle shown in FIGS. 1-4.
Figure 6:
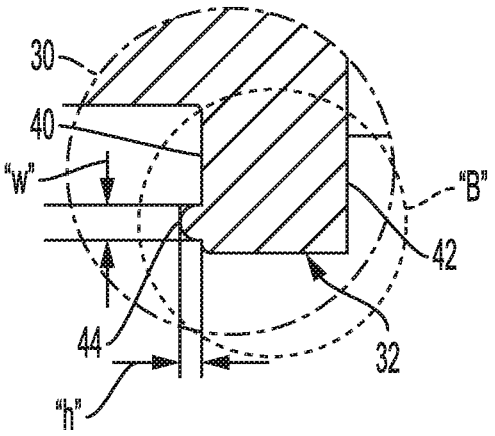
FIG. 6 is a magnified, cross-sectional view of the area designated "A" in FIG. 5, taken through the line "C-C" of FIG. 3.

Referring to FIGS. 3 and 4, the contacts 24 are socket contacts. Each contact 24 is configured to receive a corresponding pin contact 106 of the plug 12. In alternative embodiments, the contacts 24 of the receptacle 14 can be pin contacts configured to mate with corresponding socket contacts of the plug 12.

The interface between each contact 24 and the insert 22 can be sealed by a suitable means such as silicon. The receptacle 14 includes six of the contacts 24 positioned in a 28-22 arrangement. Three of the contacts 24 are size-4 contacts, and the remaining three contacts 24 are size-16 contacts. Alternative embodiments of the receptacle 14 can include more, or less than six contacts 24 that are positioned in other arrangements, and are sized differently than the contacts 24.

Each contact is 24 is electrically and mechanically connected to a corresponding wire lead of a multi-wire cable 118. The cable 118 is depicted schematically in FIG. 1, and connects the receptacle 14 to the second electrical component 117. The contacts 24 are crimp contacts;

alternative embodiments can be equipped with other types of contacts, such as solder cup contacts. The receptacle 14 also includes a grommet 23 located within the internal volume 38, behind the insert 22; the grommet 23 is shown in FIG. 4. The wire leads of the cable 118 pass through the grommet 23, which seals the interface between the receptacle 14 and the wire leads.

The threads on the exterior of the rearward portion 36 of the body 30 engage a cable clamp and bushing assembly (not shown) that provides strain relief for the cable 118, and seals the interface between the receptacle 14 and the cable 118.

Referring to FIGS. 2-5, the flange 32 has a substantially planar forward face 40, and a substantially planar rearward face 42. The forward face 40 is oriented toward the plug 12 when the plug 12 and the receptacle 14 are mated. The forward portion 34 of the body 30 extends through an aperture 52 in the panel 50, and the forward face 40 of the flange 32 faces the surface 54 of the panel 50 when the receptacle 14 is mounted on the panel 50. The receptacle 14 can be secured to the panel 50 by clinch nuts (not shown) disposed in apertures 46 formed in the flange 32; other suitable means for securing the receptacle 14 to the panel 50 can be used in the alternative.

The shell 20 is grounded by way of the panel 50. The flange 32 includes a projection in the form of a rib 44 depicted in FIGS. 2, 3, and 5-7. As discussed below, the rib 44 can enhance the electrical contact between the shell 20 of the receptacle 14 and the panel 50, thereby improving the electrical bonding between the connector 10 and the panel 50.

Figure 7:
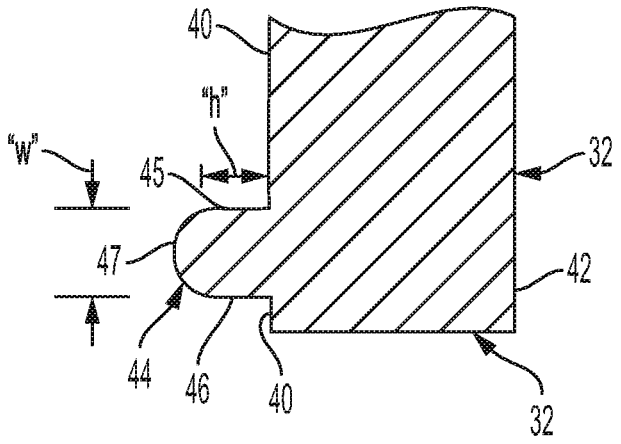
FIG. 7 is a magnified view of the area designated "B" in FIG. 6.

The rib 44 can be unitarily formed with the remainder of the flange 32, and projects from the forward face 40 of the flange 32. As can be seen in FIG. 7, the rib 44 has a first side surface 45 and a second side surface 46 that adjoin, and are oriented approximately perpendicular to the forward face 40. The rib 44 also has a rounded end portion 47 that adjoins the first side surface 45 and the second side surface 46. These features give the rib 44 an approximately D-shaped cross section.

The rib 44 is continuous, and is circular or ring-shaped when viewed from a perspective in front of the receptacle 14, i.e., from the perspective of FIG. 3. The rib 44 has a width and a height denoted in FIG. 7 by the respective characters "w" and "h." The width "w" is about 0.025 inch to about 0.035 inch; and the height "h" is about 0.015 inch to about 0.025 inch. The radius of curvature of the end portion 46 is about 0.065 inch to about 0.085 inch full radius. The preceding dimensions are presented for illustrative purposes only; the optimal values for the dimensions of the rib 44 can vary with factors such as the overall size of the receptacle 14; the clamping force between the receptacle 14 and the panel 50; and the materials from which the flange 32 and the panel 50 are formed.

The rib 44 can be non-continuous in alternative embodiments. Also, the overall shape of the rib 44 can vary according to the overall shape of the receptacle 14. For example, the rib 44 can be approximately D-shaped, as viewed from a perspective in front of the receptacle 14, when the rib 44 is used on a D-sub connector. The rib 44 can be formed separately from the remainder of the flange 32, and can be secured to the forward face 40 of the flange 32 by adhesive or other suitable means in alternative embodiments.

Figure 9:
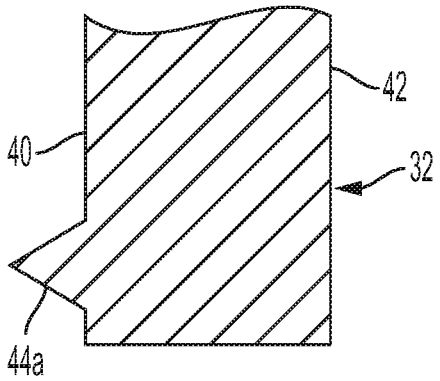
FIG. 9 is a cross-sectional view of an alternative embodiment of the receptacle shown in FIGS. 1-7, from a perspective identical to that of FIG. 7.
Figure 10:
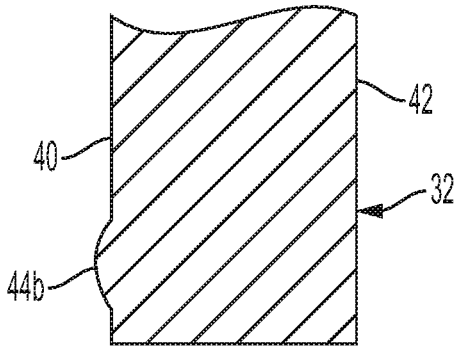
FIG. 10 is a cross-sectional view of another alternative embodiment of the receptacle shown in FIGS. 1-7, from a perspective identical to that of FIG. 7.

The cross-sectional profile of the rib 44 can vary from that disclosed herein. For example, FIG. 9 depicts a rib 44*a* having an approximately triangular cross section; and FIG. 10 shows a rib 44*b* having an entirely arcuate outer surface. Other possible cross-sectional profiles for the rib 44 include, without limitation, semi-circular, square, and rectangular.

Alternative embodiments of the receptacle 14 can be configured so that the rearward portion 36 of the body 30 extends through the aperture 52 in the panel 50, and the rearward face 42 of the flange 32 faces a forward-facing surface 55 the panel 50 when the receptacle 14 is mounted on the panel 50. In such alternative embodiments, the rib 44 can be located on the rearward face 42, instead of the forward face 40, of the flange 32.

Figure 8:
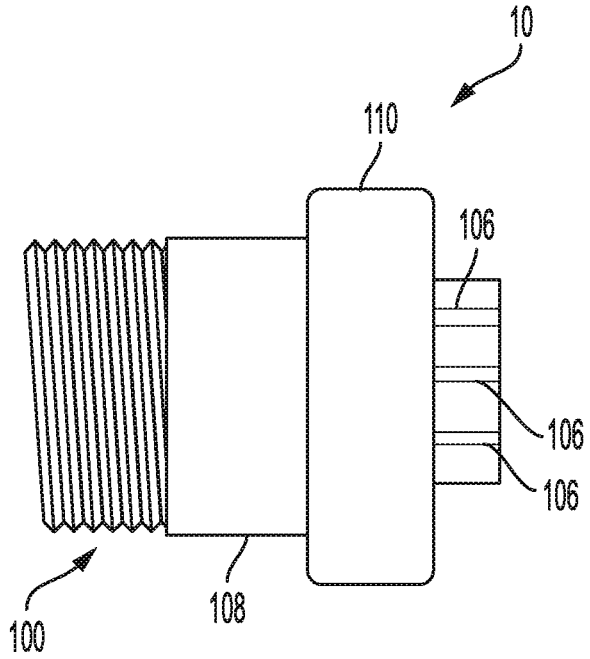
FIG. 8 is a side view of the plug of the connector shown in FIG. 1.

Referring to FIG. 8, the plug 12 comprises a shell 100, an insert (not shown) mounted within the shell 100, and six pin contacts 106 mounted within the insert 104 and depicted in phantom. The shell 100 includes a body 108, and a coupling nut 110 mounted for rotation on the body 108.

Each contact 106 is sized and positioned to be received by a corresponding contact 24 of the receptacle 14 when the plug 12 and the receptacle 14 are mated. The contacts 106 are each electrically and mechanically connected to a corresponding wire lead of a multi-wire cable 120, depicted schematically in FIG. 1. The plug 12 further includes a grommet (not shown) located within the shell 100, behind the insert. The wire leads of the cable 120 pass through the grommet, which seals the interface between the plug 12 and the cable 120. The cable 120 connects the plug 12 to the first electrical component 116.

The coupling nut 110 engages the threads on the forward portion 34 of the body 30 of the shell 20 when the plug 12 and the receptacle 14 are mated, thereby retaining the plug 12 and the receptacle 14 in a mated condition.

The connector 10 is grounded through the panel 50. The bonding of the connector 10 to the panel 50 occurs by way of contact between the shell 20 of the receptacle 14, and the surface 54 of the panel 50. The rib 44 concentrates the surface contact between the shell 20 and the panel 50 over a relatively small area that is disposed in a substantially symmetric manner around the centerline of the receptacle 14. Therefore, the clamping force generated by the fastening of the receptacle 14 to the panel 50 is concentrated in the relatively small contact area between the rib 44 and the surface 54; and is distributed with substantial uniformity around the contact area when the clinch nuts or other fastening means between the receptacle 14 and the panel 50 are uniformly tightened. It is believed that this concentrated, uniformly-distributed contact force substantially reduces the grounding resistance between the receptacle 14 and the panel 50, and thereby provides a substantial improvement in the bonding between these components, in comparison to a conventional receptacle in which the relatively large rearward face of the flange directly contacts the surface 54. Also, it is believed that the concentrated force exerted by the relatively narrow rib 44 against the surface 54 causes a localized deformation of the surface 54, i.e., the rib 44 digs into the surface 54 so that the surface 54 conforms substantially to the shape of the rib 44. This conformance of the contacting surfaces is believed to further enhance the bonding between the receptacle 14 and the panel 50.

Also, it has been found that the bonding between the receptacle 14 and the panel 50 improves after repeated mating and de-mating of the receptacle 14 and the panel 50. It is believed that this improvement is due to an increase in the localized deformation in the surface 54 resulting from repeated applications of force by way of the rib 44.

What is claimed is:

1. A receptacle for mating with a plug to establish an electrical connection, the receptacle comprising:

at least one electrical contact;

an electrically-insulating insert, wherein the at least one electrical contact is positioned at least in part within the insert; and a shell configured for mounting on a substantially planar mounting surface; the shell comprising a body, and a flange attached to the body; wherein: the insert is positioned at least in part within the body; and the flange comprises a projection comprising a non-flexible rib configured to contact and deform the mounting surface when the receptacle is mounted.

2. The receptacle of claim 1, wherein the rib is continuous.

3. The receptacle of claim 1, wherein the rib has a substantially D-shaped cross section.

4. The receptacle of claim 1, wherein the rib has a substantially triangular cross section.

5. The receptacle of claim 1, wherein the rib has a substantially arcuate outer surface.

6. The receptacle of claim 1, wherein the rib is disposed substantially symmetrically about a longitudinal centerline of the receptacle.

7. The receptacle of claim 1, wherein the rib is ring shaped.

8. The receptacle of claim 1, wherein the at least one electrical contact is a receptacle contact.

9. The receptacle of claim 1, wherein the at least one electrical contact is a pin contact.

10. The receptacle of claim 1, wherein the body and the flange of the shell are unitarily formed.

11. An electrical connector, comprising the receptacle of claim 1, and a plug configured to mate with the receptacle to establish an electrical connection.

12. The receptacle of claim 1, wherein: the mounting surface is a substantially planar surface of a panel; and the contact between the rib and the mounting surface electrically bonds the shell to the panel.

13. The receptacle of claim 12, wherein the flange has a surface configured to face the panel when the receptacle is mounted on the panel; and the rib extends from the surface of the flange.

14. The receptacle of claim 13, wherein the rib extends along a circular path on the surface.

15. The receptacle of claim 1, wherein the rib has a width of about 0.025 inch to about 0.035 inch.

16. The receptacle of claim 15, wherein the rib has a height of about 0.015 inch to about 0.025 inch.

17. A method for bonding a receptacle of an electrical connector to a panel, comprising:

providing a receptacle comprising: a shell comprising a body, and a flange attached to the body and comprising a projection, the projection comprising a non-flexible rib; an electrically-insulating insert positioned at least in part within the body; and at least one electrical contact positioned at least in part within the insert;

inserting a portion of the receptacle through an aperture in the panel so that the rib contacts a surface of the panel adjacent the aperture; and securing the receptacle to the panel so that the rib deforms the surface of the panel.

18. The method of claim 17, wherein securing the receptacle to the panel comprises fastening the flange to the panel so that a contact pressure between the rib and the surface of the panel is substantially uniform along the rib.

19. The method of claim 17, wherein securing the receptacle to the panel comprises fastening the flange to the panel so that substantially all contact between the flange and the surface of the panel occurs by way of the rib.

* * * * *